United States Patent [19]

Le Perchec et al.

[11] Patent Number: 4,869,804

[45] Date of Patent: Sep. 26, 1989

[54] PROCESS FOR THE THERMAL CONVERSION OF HEAVY PETROLEUM FRACTIONS AND REFINING RESIDUES, IN THE PRESENCE OF OXYGEN COMPOUNDS OF SULFUR AND NITROGEN AND COMPOSITIONS CONTAINING THESE COMPOUNDS

[75] Inventors: Pierre Le Perchec, Lyons; Bernard Fixari, Vienne; Béatrice Debled; Michel Thomas, both of Villeurbanne, all of France

[73] Assignee: Institut Francais du Petrole, Rueil-Malmaison, France

[21] Appl. No.: 125,261

[22] Filed: Nov. 25, 1987

[30] Foreign Application Priority Data

Nov. 25, 1986 [FR] France ..... 86 16408

[51] Int. Cl.[4] ..... C10G 9/00

[52] U.S. Cl. ..... 208/106; 208/46; 208/107; 208/291; 208/125; 208/286; 208/290; 208/142; 208/143; 208/108; 208/113; 252/48.2; 252/51

[58] Field of Search ..... 208/106, 108, 107, 113, 208/46, 291, 125, 286, 290, 143, 142; 252/48.2, 51 R

[56] References Cited

U.S. PATENT DOCUMENTS 4,469,586 9/1984 Ferm ..... 208/48 AA
4,695,370 9/1987 Galtier et al. ..... 208/113

FOREIGN PATENT DOCUMENTS 32019 7/1981 European Pat. Off. .
0183269 6/1984 European Pat. Off. .

*Primary Examiner*—Helane Myers
*Attorney, Agent, or Firm*—Millen, White & Zelano

[57] ABSTRACT

A process for the thermal conversion of various fossil organic materials such as heavy crude oils, heavy petroleum fractions or refining residues, is described. According to the invention, the charge is subjected to thermal processing in the presence of a minor proportion of at least one radical-generating monooxygenated compound, containing at least one heteroelement selected from sulfur, and nitrogen and in which the oxygen is borne by said heteroelement. The conversion is improved with a composition comprising a hydrogen donor diluent and this monooxygenated compound in a weight ratio of 0.2:1 to 400:1. The invention is useful in the petroleum industry and the coal industry and particularly in the process of hydrovisbreaking.

19 Claims, 1 Drawing Sheet

PROCESS FOR THE THERMAL CONVERSION OF HEAVY PETROLEUM FRACTIONS AND REFINING RESIDUES, IN THE PRESENCE OF OXYGEN COMPOUNDS OF SULFUR AND NITROGEN AND COMPOSITIONS CONTAINING THESE COMPOUNDS

BACKGROUND OF THE INVENTION

The invention relates to a process for the thermal conversion of a charge consisting of a heavy fraction of organic material in the presence of oxygenated organic compounds of sulfur or of nitrogen, and to a composition comprising these compounds.

It is particularly applicable in the industry for the refining of petroleum and coal and particularly for processes of viscoreduction and catalytic hydroprocessing.

Improvement in the thermal treatment processes used in the petroleum industry for the refining of fossil organic materials rich in heavy polyaromatic structures, coke promoters, such as heavy petroleums and related materials: bituminous schists, coal, asphaltic sands and refining residues, involves the control of the processes of radical transformations by the employment of solvents or effective additives.

Numerous works have been devoted to the employment of hydrogen donor solvents (hydroaromatic structures such as tetraline, dihydroanthracene or partially hydrogenated petroleum fractions), capable of efficiently inhibiting the development of the radical reactions of chain polycondensation or chain polymerization.

However, under identical conditions, the use of an efficient hydrogen donor results in a conversion of light fractions which is more moderate when there are eliminated from the reaction medium reactive intermediates which promote processes of fragmentation of the chains. This aspect of the problem has led to the association of additives capable of performing as a group radical capture and activation of the fragmentation of the polymolecular agregates present in these heavy fractions.

Various studies mention the effect of hydrogen sulfide present during treatment of petroleum fractions rich in sulfur as a compound capable of a double catalytic role; on the one hand, the improvement of the kinetics of hydrogen transfer and hence of the efficiency of free radical capture on the other hand, activation of fragmentation reactions. However, their synergetic use with hydrogen donor solvents has been only a little exploited.

Recent works describe the activating effect of certain thiols (EP 175,511) and organic disulfides (benzenethiol, dodecanethiol and the like, and diphenyldisulfide-) as well as a precursor of hydrogen sulphide ammonium sulphide. These compounds have the drawback of being expensive and of partly decomposing during the thermal treatment; they then can not be regenerated. In a prior document, in particular, dimethyldisulfide is used as promotor of the viscoreduction in the presence of nickel naphthenate (BE 901,092).

Other types of activators have been recommended in the prior art, such as radical generators (US 4,298,455); generally, these additives have various reactional insufficiencies, particularly:

the thermal formation field of the reactive species is too limited from generators such as hydrogen peroxide, hydroperoxides and organic peroxides. This temperature, generally less than 200° C., leads to insufficient stability for their effective action in the medium at the temperatures usually utilized.

their action consists rather of a prior chemical modification to the thermal treatment proper; in addition poor selectivity is observed due to the fact of the often sudden and exothermic decomposition of these compounds;

they show a potential non-regenerability due to the fact of their total decomposition.

In addition, the prior art describes in patent EP 183,269 a mixture of compounds based on molybdenum selected from anong the mixture of molybdenum dithiophosphate and carboxylate and the mixture of molybdenum dithiocarbonate and carboxylate.

Finally, the U.S. Pat. No. 4,298,455 mentions the association of azobisisobutyronitrile with sulfurized or chlorinated compounds.

It is a particular object of the invention to remedy the above-indicated drawbacks.

SUMMARY OF THE INVENTION

It has in fact been discovered that the employment, in heavy fractions of fossil organic materials to be subjected to thermal conversion treatment, of oxidized species more particularly in the form of organic monooxides of sulfur, and/or nitrogen, enables the conversion of these heavy fractions to be improved, apparently by radical activation (these oxidized species can be added to the heavy fraction to be processed of produced in situ).

The presence of these oxidized species (added or produced in situ) during the thermal treatment of the heavy fractions concerned, enables in particular the obtaining at lower temperature of conversions similar to those obtained, in their absence, in conventional treatments.

In association with hydrogen donors, these oxidized species enable the improvement, at the usual temperatures of thermal treatment, of the overall conversion of the charges with the achievement of a distinct reduction in Conradson carbon and the ratio of asphaltene. In addition, the synergy observed with the hydrogen donors enables the achievement of thermal treatments which effect conversion at higher temperatures and enable obtaining a fuller conversion without coking.

The effectiveness of the organic monooxides in the process according to the invention is apparently due to the action at high temperature of oxygenated species such as nascent oxygen, and/or sulfinyl radicals (RSO°) in the case of sulfoxides, and shows itself to be different and substantially superior in their use in association with hydrogen donors.

Another advantage of the process according to the invention resides in the fact that certain of the organic monooxides employed, after having acted during the thermal treatment, can resume a reduced form, stable at the temperature of treatment and then be recovered, for example, by distillation to be recycled, after re-oxidation under specific conditions ex situ.

The "heavy fractions" of organic fossil materials concerned in the invention may consist more particularly of heavy crude oils, of heavy petroleum fractions, of refining residues, or of schists, of bituminous sands or of coal.

The invention applies to various thermal treatments, in particular the visbreaking of distillation residues (temperatures of about 350° to 470° C., advantageously from 380° to 450° C., preferably 400° to 440° C.) and to hydrovisbreaking at temperatures of the same order, under pressures which, generally are situated between 10 and 150 bars at the temperatures of treatment with residence times of about 1 to 60 minutes.

Generally, the invention is directed to a conversion process of a heavy petroleum, of a heavy petroleum fraction or of a refining residue, in which said heavy petroleum, said heavy petroleum fractions or said refining residue is subjected to thermal treatment, the process being characterized by the fact that the thermal treatment concerned is carried out in the presence of a minor proportion of at least one oxygen compound which is a free radical generator containing at least one heteroelement selected from among sulfur and nitrogen and in which said heteroelement carries an oxygen atom.

The free radical generator oxygen compound, generally an organic monooxide of sulfur, and or of nitrogen, may be added to the charge to be treated in the proportion of 1 to 50%, advantageously from 1 to 20% and preferably 5 to 15% by weight with respect to said charge.

The action of the oxygen compound in the process according to the invention may be reinforced by the use of a hydrogen donor diluent, used in general, in proportion of 10 to 400%, advantageously from 30 to 200% and preferably from 5 to 100% by weight, in respect to the charge to be processed.

Among the organic monooxides concerned in the process according to the invention, may be mentioned more particularly:

Oxides of sulfur compounds having from 2 to 30 carbon atoms such a dialkylsulfoxides, for example, dimethysulfoxide, diarylsulfoxides, for example diphenylsulfoxide, alkylarylsulfoxides and oxides of thiophenic sulfur, for example benzothiophene-sulfoxide or dibenzothiophene-sulfoxide;

amine oxides containing from 1 to 30 carbon atoms and preferably from 1 to 10 carbon atoms such as oxides of trialkyl- and triarylamines or oxide of amines with at least one alkyl group and at least one aryl group and oxides or aromatic nitrogen, for example pyridine N-oxide or quinoline N-oxide.

At the equivalent atomic concentration of the atom (bearing the oxygen) of sulfur or of nitrogen, it is preferable to use low molecular weight additives. The dimethylsulfoxide prepared according to U.S. Pat. No. 3,045,851 has the advantage of being inexpensive and a good solvent of petroleums and diluent hydrogen donors. Diphenylsulfoxide is more expensive but can be recycled, to a small extent, from the diphenylsulfide resulting from the loss of oxygen (Synthetic communication p.1025, 1981). Didodecylsulfoxide is prepared from didodecylsulfide (Synthesis p.447, 1975), which is then oxidized as described in "Synthetic communication". Pyridine N-oxide, for example, is easily prepared from pyridine which can be recycled (J. of Chem. Soc. p. 1769 1957).

To introduce these organic monoxides into the charge to be processed, it is possible to use the substances as such when they are available. It is also possible advantageously to use hydrocarbon fractions containing sulfur, and/or organic nitrogen in the state of monooxides, produced by known specific oxidising treatments described, for example, in the publication J. C. Peterson et al, A.C.S. Div. Fuel 26(4), 898, 1981 and in the patent USSR, SU 1,214,660.

According to another embodiment of the process according to the invention, it is possible to produce oxygen compounds of sulfur, and/or nitrogen in situ, in the charge to treated, by employing gentle oxidation of the latter, in particular by means of peroxide (in general hydrogen peroxide, for example in admixture with water or, preferably with methanol). As the treated functions generally contain sulfur compounds and, in certain cases nitrogen compounds, gentle oxidation produces in the medium principally sulfoxides, and in certain cases, organic nitrogen oxides according to the invention. Oxygen introduced in this manner is then liberated in the course of the thermal treatment.

In another embodiment, it is possible to produce ex situ the oxygen compounds of sulfur and/or of nitrogen in a charge and to use this fraction as a generator of oxygenated species in the treatment of a heavy petroleum fraction.

Among the hydrogen donor diluents useful in association with the organic monooxides, may be mentioned those described in the patent EP 32,019 and advantageously, for example, tetrahydronaphthalene (or "Tetraline"), or dihydroanthracene (DHA), or as in the prior art, a partially hydrogenated LCO (light cycle oil) fraction.

The invention also relates to a composition containing at least one monooxygenated organic compound as defined above, and at least one hydrogen donor diluent as defined above, advantageously tetrahydronaphthalene or dihydroanthracene.

The ratio by weight of the hydrogen donor with respect to the monooxygenated organic compound is said composition is in general 0.2:1 to 400:1 and preferably from 3:1 to 20:1.

The proportion by weight of the composition introduced into the charge which has to undergo thermal treatment is generally from 11 to 450 parts per 100 parts of a charge consisting of a heavy fraction of organic substances and preferably from 55 to 115 parts per 100 parts of said charge.

The following examples illustrate the invention and must in no way be considered as limiting.

BRIEF DESCRIPTION OF THE DRAWINGS

In the accompany drawings.

DESCRIPTION OF PREFERED EMBODIMENTS

EXAMPLE 1

The first series of tests 1 to 22 bears on a hydrovisbreaking of a residue under vacuum (RUV) 500° C.+ of SAFANIYA origin. Test 1, 3, 6, 10, 13, 14, 15 and 18 are given by way of comparison.

The characteristics of the residue were as follows:

| | |
|---|---|
| density; | 1.028 kg/l |
| viscosity at 100° C.: | 5900 cP (mPa.s) |
| % by weight | 12.4 |
| n-heptane asphaltenes: | |
| % by weight | 22.0 |
| of Conradson carbon: | |
| Elementary analysis: | |
| % C (weight): 83.27 | % N (weight): 0.42 |

-continued

| | |
|---|---|
| % H (weight): 10.43 | % O (weight): 0.78 |
| % S (weight): 4.73 | Balance C + H + S + N + O: 99.63% |
| V: 140 mg/kg | Ni: 46 mg/kg |

Figure 1:
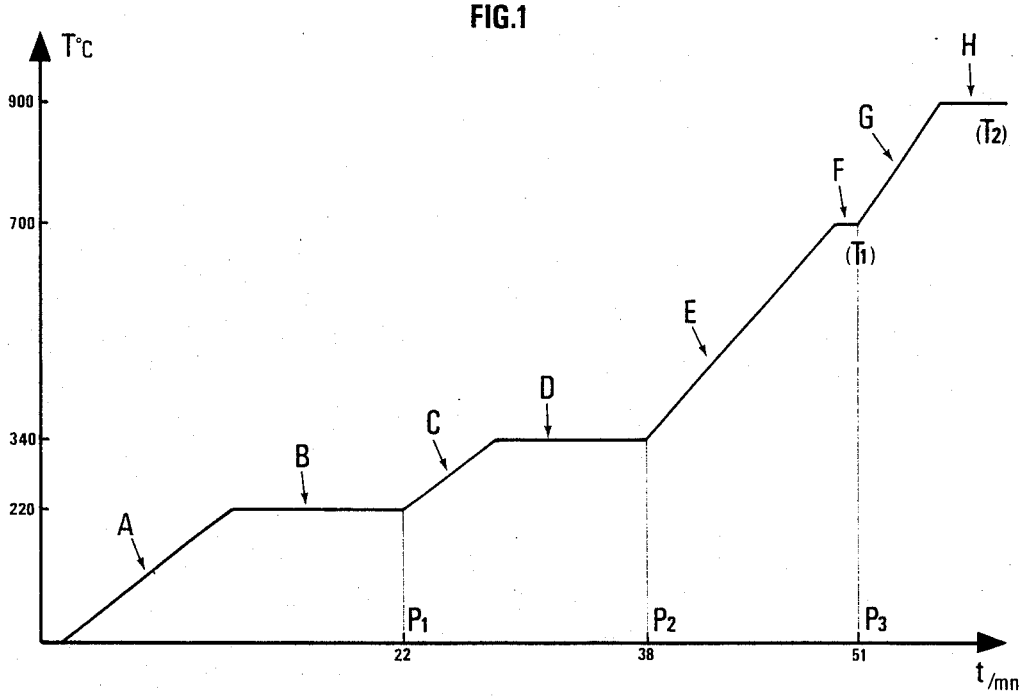
FIG. 1 shows the temperature profile of the method of analysis (pyroanalysis), whilst

The untreated residue under vacuum and the liquid fraction resulting from the hydrovisbreaking were analysed by pyro analysis. This method comprises the following:

the specimen is heated under an inert atmosphere to a temperature $T_1$ and a combustion is performed for a gas mixture (He+3% $O_2$) of the heating effluents in the presence of an oxidation catalyst (CuO); the oxidation compounds, particularly $CO_2$, are detected, for example, by an infared detector: and the residue remaining after heating in an atmosphere is in its turn oxidized with the same mixture (He+$O_2$ at 3%) up to a temperature $T_2$ and, after passage into a CuO catalyst, the oxidation compounds of the residue (residual carbon) are detected by the same type of detector and the signals are processed by a computer. The heating temperature and time profile is as follows, V representing heating rate and t representing time. (FIG. 1).

$V_A=V_C=20°$ C./min; $V_E=30°$ C./min; $V_G=100°$ C./min $t_A=11$ min, $t_B=10$ min, $t_C=6$ min, $t_D=10$ min $t_E=12$ min, $t_F=1$ min, $t_G=2$ min, $t_H=2$ min.

The points $P_1$ and $P_2$ correspond to n-alkanes heated under the same conditions and whose boiling points are respectively equal to 500° C. and 620° C. From the point $P_3$ the combustion of a residual carbon performed.

Figure 2:
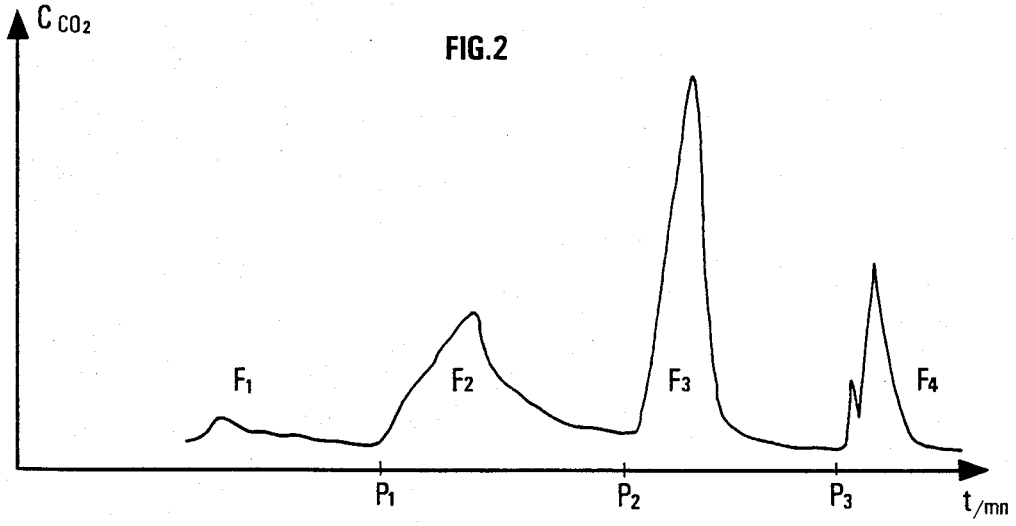
FIG. 2 shows the pyrogram corresponding to the concentration of $CO_2$ as a function of time or of the reference temperature.

The program obtained (FIG. 2) gives the concentration of $CO_2$ as a function of time or of the temperature of the oven. It is possible to calibrate the scale of the abscissae in boiling point of reference compounds (n-alkanes, for example), heated under the same conditions. It is easily possible to fractionate the pyrogram by integration of the signal between the temperature values selected, for example according to the fractions below In the case of the untreated residue under vacuum the percentages of the various fractions are indicated below:

| | |
|---|---|
| $F_1$: fraction 40–500° C.: | 6% |
| $F_2$: fraction 500–620° C.: | 39% |
| $F_3$: fraction 620° C.$^+$: | 41% |
| $F_4$: Residual Carbon: | 14% |

The fractions $F_2$ and $F_3$ represent the fraction 500° C.—end of distillation in the tables below.

By calibration of the response of the detector it is easy to obtain the carbon weights corresponding to the above fractions. In the same way, the percentages and weights of hydrogen and of sulfur contained in the specimen are obtained in simultaneity with those of the carbon.

Centesimal analysis of the charges subjected to hydrovisbreaking shows that the sum of the weights of C, H and S is still greater than or equal to 95%. Consequently the simple addition of these weights enables the respective actual percentages of the various fractions above of the liquid fraction to be obtained with sufficient accuracy.

This method of analysis is used for all the tests 1 to 22 described in the invention.

The concentrations by weight of the sulfur compound, are such that the ratio of sulfur introduced expressed in % by weight with respect to the charge is identical in each test namely: 0.213 mole of sulfur for 100 g of residue under vacuum SAFANIYA.(RSV)

The petroleum charge (RSV SAFANIYA) (about 30 g), after slight heating (100–120° C.) to render it less viscous, is introduced into the reactor which is in a stainless steel autoclave. The possible additives are introduced after cooling the whole is stirred constantly.

All the hydrovisbreaking tests were carried out under an initial pressure (at 20° C.) of 50 bars of hydrogen, vigorously, at 430° C. for 15 minutes in the presence of a hydrogen donor and monooxide compound and at low severity at 390° C., in the presence of monooxide compound alone, after a time of rise to the hydrovisbreaking temperature of about 25 minutes.

The weights selected by way of example as hydrogen donor diluent (HDD) are related to the charge comprising 50% of HDD and 50% of RSV to which are added an amount of sulfur additive such that it represents 0.213 atoms of sulfur per 100 g of residue.

In the presence simultaneously of HDD and of monooxide compound of sulfur and of nitrogen, the concentration by weight with respect to the RUV are identical with those used with the additives alone.

After the visbreaking treatment, there is generally obtained a polyphase system:

a solid phase, the coke a liquid phase containing a part of the initial substances or of the cracking products, and a gaseous phase.

The liquid products and the possible coke are collected directly or by dissolving in benzene, this operation being followed by evaporation; the gases are not recovered but are calculated by difference between the amounts introduced and collected.

The coke is defined as being the portion insoluble in hot benzene. A determination is performed for each test. The amount of liquid is calculated after determination of the coke level.

The ratios of gas, liquid and coke are expressed with respect to the petroleum alone after deduction of the additives. Two examples of deduction are given below, with the following remarks relating to the additive (HDD) and the monooxygenated sulfur compound:

an additive such as tetraline (TET) is, after pyrolysis, contained integrally in the liquid fraction from which it is deduced.

the dimethylsulfoxide is totally converted (confirmed by determination, by gas phase chromatography) in water, methane and hydrogen sulfide. The water is deduced from the liquid fraction, the two other compounds from the gaseous fraction.

The conversion of the petroleum on hydrovisbreaking is obtained in the following manner (example of test 12):

STEP 1—Calculation of the distribution of petroleum between the phases.

The charge submitted to visbreaking comprises 50 g of RSV SAFANIYA+41.7 g of tetraline +8.3 g of dimethylsulfoxide namely 100 g in total.

After treatment, 0.5 g of coke is isolated (benzene insoluble in the liquid fraction) and 91.9 g of overall liquid fraction. By difference of 100 g the total gaseous fraction is deduced namely 7.6 g. The gas is composed of $H_2S$ and $CH_4$ derived from the DMSO namely 6.6 g, consequently the weight of the cracking gas of the petroleum is 1 g. The liquid petroleum fraction is constituted by 91.9 g—41.7 g (tetraline)—1.7 g (oxygen coming from the DMSO being in the form of water), namely 48.5 g coming from the visbreaking of the petroleum.

These results provide the distribution gas/liquid/-coke of the hydrovisbreaking results (additives deducted), namely:

| | |
|---|---|
| % coke: | (0.5 × 100)/50 = 1% |
| % liquid: | (48.5 × 100)/50 = 97% |
| % gas: | (1 × 100)/50 = 2% |

STEP 2: Calculation of the conversion of the petroleum:

By pyroanalysis the percentage of the total liquid fraction possesing a boiling point below 500° C. is measured, namely at 74.2% taking into account the additives (tetraline and DMSO) in the case of test 12. This represents therefore 91.9×74.2=68.2 of the 100 g of the initial charge. After the deduction of the 41.7 g of tetraline and of the 1.7 g of water one obtains 24.8 g of petroleum possesing a boiling point below 500° C. in the liquid fraction.

The RSV SAFANIYA already possesing 6% of fraction 500° C.-, this represents 3 g for the 50 g of petroleum employed. They are therefore deduced from the 24.8 g to give 21.8 g of liquid 500° C.- and finally the weight of gas is added to arrive at the weight of 22.8 g of 500° C.- created by the hydrovisbreaking.

The conversion is hence (22.8×100)/50=45.6

This method of calculation is valid for all the tests 1-22.

Table 1 recapitulates the results of tests 1-7, performed under a hydrovisbreaking temperature of 390° C.

The addition of dimethylsulfoxide (test 2), of didodecylsulfoxide (test 4), of diphenylsulfoxide (test 5), of pyridine N-oxide (test 7) to the residue (RSV) contributes to improving the conversion of the petroleum in 500° C.- with respect to that carried out on the residue alone (test 1 ). By respective comparison, the additives such as dimethylsulfide (test 3) or diphenylsulfide (test 6) added to the residue contribute to results where the values of the conversion into 500° C.- and of the distribution of the petroleum are substantially identical with those obtained on the residue under vacuum.

Table 2 relates the results of Test 1 and 8-15 corresponding to a hydrovisbreaking temperature of 430° C.

RSV alone (test 1) shows the conversion of 47.2% respective levels of coke and gas of 6.6 and 7.8% by weight. The introduction of DMSO into the residue (test 8,9) brings the conversion to a high level and enables a higher level of coke and of gas to be obtained, showing an advantageous conversion effect.

The introduction of tetraline into the RSV residue (test 10) results in an inhibition of the formation of coke and of gas but a limited conversion.

The association tetraline and DMSO (tests 11 and 12) enables a gain in quality and the level of coke and of gas to be maintained substantially at the level of Example 10 and contribute also to a favourable effect on the conversion.

By way of comparison, test 15 according to the prior art at a sulfur level comparable with that of test 12 conducted according to the invention, shows that the association thiophenol and tetraline contributes to substantially lower conversion and to a better quality of the petroleum recovered (see ratio of gas and of liquid as well as the distribution in fractions 40°-500° C. of the liquid fraction). Test 14 shows for its part, the contribution of thiophenol alone at a sulfur concentration substantially identical with that of test 8 and 15.

Lastly, by way of comparison, there is also given test 13 where the association tetraline and dimethylsulfide (with a substantially identical sulfur content) does not achieve the good results of example 12 according to the invention.

Table 3 recapitulates the results of tests 1, 10 and 16-22.

By tests 16 and 17 which are compared with tests 1 and 10 it is shown that diphenylsulfoxide contributes essentially to a better conversion, that the association tetraline and diphenylsulfoxide contributes at the same time to a good conversion and to a good distribution of the petroleum, these results being better than those observed with the association tetraline and diphenylsulfide (test 18).

Test 21 and 22 show the influence on the one hand of didodecyl sulfoxide and on the other hand that of didodecyl sulfoxide and tetraline where the effect both on the conversion and the distribution of the petroleum is again observed.

Lastly, the addition of pyridine N-oxide and of the association pyridine N-oxide and tetraline according to the invention (test 19 and 20) enables the improvement respectively of the conversion and the quality of petroleum recovered together to be improved (tests to be compared with tests 1 and 10) but in a more limited manner.

Tetraline is used as a hydrogen donor diluent but it was observed that with other hydrogen donors such as dihydroanthracene, used under the same conditions, substantially the same results are observed.

It has also been shown that it was possible to obtain substantially similar results, particularly at the level of low ratios of gas and of coke in visbreaking units operating dynamically.

EXAMPLE 2

A second series of tests 23-30 bears on visbreaking treatments of an atmospheric residue of BOSCAN origin (RAB). Tests 23, 25, 27 and 29 were performed byway of comparison.

Certain characteristics of the atmospheric residue used, noted in the following RAB, are given in the Tables 4, 5 and 6 below. In Table 4 there is given particularly:

the % by weight of asphaltenes: 27.5% and the viscocity of 100° C.: 2500cP (mPa s)

Table 6 gives the elementary analysis of the RAB.

Tables 4 and 5 give the percentages of the fractions 100°-500° C., 500°-570° C., 570° C.+ and of the residue (residual peak) obtained by the method of pyronanalysis already described above in connection with the tests 1 to 22.

The atmospheric residue was subjected to gentle oxidation by means of hydrogen peroxide according to the procedure described below.

20 g of atmospheric residue of BOSCAN origin were dissolved in 450 ml of a 50/50 mixture by volume of methanol and of benzene. 6.5 ml of aqueous 30% hydrogen peroxide solution ($H_2O_2$ of at least 110 volumes, was added, which corresponds to 0.076 mole of $H_2O_2$, namely a molar ratio $H_2O_2$ /sulfur of 2.3.

The solution was then brought to reflux (70°-75° C.) for 15 hours, then it was cooled to 20° C. A decantation was performed. The solution was then washed twice with water and dried by azeotropic distillation, then evaporated to dryness.

Certain of the characterics of the oxidised atmospheric residue (RAD) obtained, are given in Tables 4, 5 and 6 and may be compared with the atmospheric residue before oxidation.

Visbreaking tests were pursued under hydrogen pressure (hydrovisbreaking and vis breaking with water).

The technique used was that of pyrolysis in an enclosed reactor under hydrogen pressure or steam pressure, as the case required.

The temperature and the pressure inside the reactor were checked by sensors connected to a computer which ensured acquisition of the data and automatic piloting of the reactor. The ranges of pressure and of temperature were respectively 0-60 bars and 0°-600° C. The pressure was ensured by the addition of 30 $cm^3$ of water or by an initial pressure of hydrogen of 20 bars.

The desired temperature was reached after 20 minutes, the duration of the level stage was 15 minutes. The pressure in the level stage of temperature was then about 40 bars for the tests under hydrogen and about 20 bars for the tests in the presence of water.

The liquid fractions were collected in benzene: the possible coke was separated by filtration in hot benzene. In the test with water, the aqueous phase was separated by decantation or by Dean-Stark entrainment which ensured effective drying of the organic phase.

In Table 4, are indicated the values of the viscosity, of the rating and of the asphaltenes levels of the different tests The ratings, marked from 1-10 result from a stain test effected on filter paper enabling the concentration of isooctane in an isooctane/xylene mixture to be determined from which the coke or the asphaltene floculation appears. For example, the value of the rating will be 8.5 for a mixture of 85% xylene and 15% isooctane.

The ration of gas corresponds approximately to a 100° C.−fraction and results from the loss in weight after evaporation of the benzene which is the recovery solvent.

The temperature of visbreaking was fixed at 420° C. which corresponds to obtaining a satisfactory stability receipt. (Rating =7, in test 23).

The receipts of test 23, 24, 25 and 26 are analysed by a so-called 'pyroanalysis' technique as described above, which gives in particular access to residual peak values and to the conversion levels.

The program of rise in temperature of this pyroanalysis is as follows: 20° C./min for 22.5 min of heating and inert atmosphere and 100° C./min for 2.5 min of combustion of the residue. The boiling points of n-alkanes at 500° C. and 570° C. correspond to heating times of 30.5 min and 16 min.

The conversion levels are calculated by difference between the fraction 100°-500° C. of the receipt and that of the initial RAB, plus the gas ratio. For example, the conversion level of the test 23 is equal to:

$$37.4-17+8.5=28.9\%.$$

Table 5 gives the percentages of the various fractions of the liquid phase and Table 6 gives the percentage analysis (C, H, N, O, S, metals) of the liquid phase.

In tests 25 and 26, 15% by weight of dihydroanthracene (DHA) was employed. The weight of DHA was reduced each time that this was possible: for the % 100°-500° C., the % of asphaltenes, the % C and H of the % analysis.

The measurement of the viscosity was done on the totality of the receipt, petroleum +dihydroanthracene at a temperature of 60° C.

The comparison of tests 23 and 24 leads to the following observations:

Under the same conditions of temperature, the phenomenon of progress to cokefaction is again found. With oxidation pre-treatment, there is 8% of coke and the liquid has a viscocity, a residual peak and a level of asphaltenes which is higher than with unoxidised RAB (170 cP against 115cP; 33.3% of $C_5$ asphaltenes against 26%).

On the other hand, the atomic ratio H/C passes from 1.54 for the initial RAB, to 1.41 for test 23 and to 1.34 for test 24, which shows the impoverishment in hydrogen due essentially to the formation of gases whose content is very large for the viscoreduced RAO (14.5%).

In fact, test 24 has a conversion level higher than that of test 23, but this increase is essentially due to the rise in the gas level.

Test 25 and 23 in Table 5, indicate that the dihydroanthracene used with the RAB do not act on the formation of light products (conversion ratio practically identical) but rather on the heavy fraction: the ashpaltenes level and the content of the residual peak are down.

The visbreaking residue has a satisfactory stability or even improved with a rating of 6.5 and is richer in hydrogen (the atomic ration H/C which is 1.55, that is to say equal to that of the initial RAB, confirms the aptitude of DHA to be a very good dehydrogenation inhibitor). Comparison between tests 24 and 26 indicates that the presence of the hydrogen donor with the oxidised RAB enables the coke formation to be totally avoided and also a considerable gain in conversion to be preserved with respect to unpreoxidised RAB, whilst having a visco reduced liquid of good stability.

The conversion gain is due to an increase in the fraction 100°-500° C. and not to an advance in the gas ration.

The stability is satisfactory; it is manifested by contents of residual peak and especially in asphalatenes which are rather low (18.4% and 20.3% respectively). In addition, the viscosity is less than that of the pyrolysed mixture. RAB-DHA under the same conditions, but unpreoxidised (330 cP at 60° against 420 cP for test 25).

In general, the centesimales analysis of the sulfur and of the metals does not show any change for the hydrovisbreaking tests (table 6).

Comparison between test 25 and 26 shows the advantage of oxidising pretreatment associated with a hydrogen donor diluent; therefrom results a better conversion of the heavy fraction (% of asphaltenes, %570°+ C. in diminution) a liquid of value which shows a lowered viscosity and a satisfactory stability.

The results of the visbreaking tests under steam pressure (P=20 bars a 420° C.) of the RAB and of RAO in the presence or not of a hydrogen donor, are indicated in Tables 7, 8 and 9.

As in hydrovisbreaking, the oxidising pretreatment (Test 28 gives an increase in weight of the visbreaking receipt viscosity higher but no coke) and a gain in conversion with respect to test 27. An increase of 30% of the conversion (the level passes from 18 to 24%) is half due to the increased formation and is half due to the fraction 100°-500° C.

Study of the distribution of the liquid phase of test 28 compared with that of test 27 shows that about 15% of the fraction 500°-570° C. (48.3% to 41.4%) is transformed by dismutation to form on the one hand, lighter products, responsible for the conversion, and on the other hand, heavier products Analysis of the metals (vanadium and nickel) shows that the thermal treatment of the oxidised charge provides good demetallisation, since more than half the nickel and of the vanadium in place is eliminated in the aqueous phase, whilst test 27 gives, after extraction, a demetallisation of about 25%. Oxidation by hydrogen peroxide in the presence of methanol does not give direct demetallisation.

Comparison of tests 27 and 29 shows a weak role of the dihydroanthracene on the RAB itself. The high value of the rating for test 18 (rating =8) is due to the presence of the mixture DHA/ anthracene which falsifies the validity of the spot test. On the other hand, the action of DHA on the RAO increases the conversion again with respect to test 29 by more than 50% (the conversion level passes to 28.1%), which a small part only is due to the increase in the ratio of gas. It is again the fraction 500°-570° C. which is responsible for this modification, but the introduction of DHA into the oxidised petroleum enables in particular very considerable modification of the fraction 570°+ C. which is reduced by ⅓ in amount (from 25.5% to 17.3%).

Thus, viscoreduction without hydrogen donor diluent of the preoxidised RAB leads to a gain in conversion, but gives a less stable visbreaking receipt.

The use of dihydroanthracene enables a gain in conversion which is very mush greater with respect to the visbreaking of the unoxidised RAB/DHA mixture, the DHA acting more particularly on the fraction 570°+ C.

Oxidising pretreatment with $H_2O_2$ /$CH_3$ OH associated with a hydrogen donor diluent, is favourable in both cases of visbreaking (tests 30 and 26). The conversion gain is proportionally greater in steam visbreaking which gives a receipt (test 30) having a percentage of 500° C. and a viscocity comparable with those obtained in the hydrovisbreaking However the quality of the viscoreduced liquid for the test under hydrogen pressure (test 26) is superior: level of asphaltenes and percentage of residual peak less, respectively 20.3% against 27% and 18.4% against 24.3%.

Another advantage of visbreaking with water of preoxidised petroleums rests on the elimination of the subsequent aqueous phase which permits a demetallisation which can reach 60% due to the oxidising pretreatment (test 28).

TABLE 1

| | HYDROVISBREAKING AT 390° C. | | | | | | |
|---|---|---|---|---|---|---|---|
| TEST | 1 | 2 | 3 | 4 | 5 | 6 | 7 |
| CHARGE % weight | RSV 100% DMSO 14,3% | RSV 85,7% DMSO 11,7% | RSV 88,3% $C_{12}SOC_{12}$ 45,1% | RSV 59,4% PhSOPh 30% | RSV 70% PhSPh 28,4% | RSV 71,6% PYR N—O 16,8% | RSV 83,2% |
| Distribution of the petroleum (additives deducted) | | | | | | | |
| % coke | 0 | 0 | 0 | 0 | 0 | 0 | 0 |
| % gas | 3,8 | 4 | 3,8 | 3,8 | 2,6 | 2,5 | 4 |
| % liquid | 96,2 | 96 | 96,2 | 96,2 | 97,4 | 97,5 | 96 |
| Distribution of the liquid fraction (additives deducted) | | | | | | | |
| 40-500° C. | 15,75 | 24,7 | 15,8 | 20,1 | 22,8 | 16,9 | 19,5 |
| 500-End DIST | 67,0 | 50,5 | 66,1 | 61,6 | 55,9 | 67,5 | 58,1 |
| Residual Carbon | 17,25 | 24,8 | 18,1 | 18,3 | 21,3 | 15,6 | 22,4 |
| Conversion of the petroleum into 500° C.- | 13 | 21,7 | 13 | 17,2 | 18,8 | 13 | 16,7 |

End DIST: end of distillation.

TABLE 2

| | HYDROVISBREAKING AT 430° C. | | | | | | | | |
|---|---|---|---|---|---|---|---|---|---|
| TEST | 1 | 8 | 9 | 10 | 11 | 12 | 13 | 14 | 15 |
| CHARGE % weight | RSV 100% | RSV 85% DMSO 15% | RSV 50% DMSO 50% | RSV 50% TETRALINE 50% | RSV 50% TET 45,85% DMSO 4,15% | RSV 50% TET 41,7% DMSO 8,3% | RSV 50% TET 43,4% DMS 6,6% | RSV 81% PhSH 19% | RSV 50% TET 39,4 PhSH 10,6 |
| Distribution of the petroleum | | | | | | | | | |
| % coke | 7,8 | 10,9 | 16,3 | 0,8 | 0,9 | 1 | 0,9 | 10,3 | 1,1 |
| % gas | 6,6 | 8,2 | 11,7 | 1,3 | 1,7 | 2 | 1,8 | 10,2 | 6 |
| % liquid | 85,6 | 80,9 | 72,0 | 97,9 | 97,4 | 96 | 97,3 | 79,5 | 92,9 |
| Distribution of the liquid fraction (additives deducted) % weight | | | | | | | | | |
| 40–500° C. | 54,4 | 59,1 | 73,5 | 36,8 | 42,25 | 51,1 | 37,5 | 58,5 | 47,1 |
| 500–End DIST | 30,25 | 25,7 | 13,5 | 50,2 | 46,2 | 37,1 | 49,6 | 26,0 | 40,3 |
| Residual Carbon | 15,25 | 15,2 | 13 | 13 | 13,55 | 13,8 | 12,9 | 15,5 | 12,6 |
| Conversion of the petroleum into 500° C.- | 47,2 | 50,0 | 58,6 | 31,3 | 36,9 | 45,6 | 32,3 | 50,7 | 44 |

TABLE 3

| TEST | 1 | 10 | 16 | 17 | 18 | 19 | 20 | 21 | 22 |
|---|---|---|---|---|---|---|---|---|---|
| | HYDROVISBREAKING AT 430° C. | | | | | | | | |
| CHARGE % weight | RSV 100% | RSV 50% TET 50% | RSV 70% PhSOPh 30% | RSV 50% TET 32,3% PhSOPh 17,7% | RSV 50% TET 33,46% PhSPh 16,54% | RSV 83,2% PYR N—O 16,8% | RSV 50% TET 40,8% PYR N—O 9,2% | RSV 59,4% $C_{12}SOC_{12}$ 45,1% | RSV 35,4% TET 29,2 $C_{12}SOC_{12}$ 35,4% |
| Distribution of the petroleum (additives deducted) | | | | | | | | | |
| % coke | 7,8 | 0,8 | 8,6 | 1 | 1,2 | 8,6 | 1 | 11,5 | 1,5 |
| % gas | 6,6 | 1,3 | 7,0 | 3,3 | 3,7 | 8,2 | 3,1 | 10,1 | 3,9 |
| % liquid | 85,6 | 97,9 | 84,4 | 95,7 | 95,1 | 83,2 | 95,9 | 78,4 | 94,6 |
| Distribution of the liquid fraction (additives deducted) % weight | | | | | | | | | |
| 40–500° C. | 54,5 | 36,8 | 58,2 | 46,3 | 44,3 | 55,0 | 40 | 61,1 | 53,8 |
| 500–End DIST | 30,25 | 50,2 | 26,8 | 38 | 41,8 | 29,9 | 44,7 | 24,2 | 31,3 |
| Residual Carbon | 15,25 | 13 | 15 | 15,7 | 13,9 | 16,1 | 15,3 | 14,8 | 14,9 |
| Conversion of the petroleum into 500° C.- | 47,2 | 31,3 | 50 | 41,6 | 39,8 | 48,0 | 35,5 | 52 | 48,8 |

TABLE 4

Hydrovisbreaking of RAB and RAO(1)BOSCAN at 420° C.
$PH_2$(420° C.) = 40 b - duration of the level stage = 15 min

| Test n° | | % gas | % 100°–500° C. | level of conversion into 500° C. | % residual peak | % $C_5$ asphaltene | rating | $\eta_{cP}$ at 100° C. |
|---|---|---|---|---|---|---|---|---|
| | RAB | — | 17 | — | 20 | 27.5 | 3 | 2500 |
| | RAO | — | 17,2 | — | 21,4 | 37,5 | 4 | 4800 |
| 23 | RAB/$H_2$ | 8,5 | 37,4 | 28,9 | 19,8 | 26 | 7 | 115 |
| 24 | RAO/$H_2$ | 14,5 | 36,3(3) | 33,8 | 22,2(3) | 33,3 | 10 (8% coke) | 170(3) |
| 25 | RAB/$H_2$/DHA(2) | 14,3 | 31,5 | 28,8 | 18,2 | 24,3 | 6,5 | 420 (à 60° C.) |
| 26 | RAO/$H_2$/DHA(2) | 9 | 39,5 | 31,5 | 18,4 | 20,3 | 8,5 | 330 (à 60° C.) |

(1)RAO = RAB oxidised with $H_2O_2/CH_3OH$
(2)% DHA = 15% (wt)
(3)non deduced coke

TABLE 5

Hydrovisbreaking of the RAB and of the BOSCAN RAO at 420° C.
Percentages of the different fractions of the liquid phase.

| Test n° | | 100°–500° C. | 500°–570° C. | 570° C.+ | residual peak |
|---|---|---|---|---|---|
| | RAB | 17 | 22,3 | 40,5 | 20 |
| 23 | RAB/$H_2$ | 37,4 | 21,9 | 20,9 | 19,8 |
| 24 | RAO/$H_2$ | 36,3 | 20,5 | 21,0 | 22,2 |
| 25 | RAB/$H_2$/DHA | 31,5 | 24,1 | 26,1 | 18,2 |
| 26 | RAO/$H_2$/DHA | 39,5 | 19,5 | 22,6 | 18,4 |

TABLE 6

Hydrovisbreaking of the RAB and of the BOSCAN at 420° C.
Centesimal analysis.

| test n° | Charge | % C | % H | % N | % O | % S | $V_{ppm}$ | $Ni_{ppm}$ | $H/C$ at. |
|---|---|---|---|---|---|---|---|---|---|
| | RAB | 82,25 | 10,43 | 0,75 | 0.97 | 5,24 | 1300 | 120 | 1,54 |
| | RAO | 81,5 | 10,1 | 0,6 | 2,2–2,5 | 5,2 | 1200 | 115 | 1,48 |
| 23 | RAB/$H_2$ | 83 | 9,75 | 0,82 | 0,96 | 5,21 | 1330 | 126 | 1,41 |
| 24 | RAO/$H_2$ | 83,50 | 9,30 | 0,82 | 1,66 | 5,14 | 1245 | 120 | 1,34 |
| 25 | RAB/$H_2$/DHA | 81,25 | 10,50 | 0,97 | 0,76 | 5,29 | 1295 | 118 | 1,55 |
| 26 | RAO/$H_2$/DHA | 82,65 | 10,25 | 0,90 | 0,90 | 5,07 | 1050 | 94 | 1,49 |

TABLE 7

Visbreaking with water of RAB and of RAO(1)BOSCAN at 420° C.
$PH_2O$ (420° C.) = 20 b - level stage = 15 min

| test n° | | % gas | % (100°–500° C.) | level of conversion | % residual peak | % $C_5$ asphaltene | rating | $\eta_{cP}$ 100° C. |
|---|---|---|---|---|---|---|---|---|
| | RAB | — | 17 | — | 20 | 27,5 | 3 | 2500 |
| | RAO | — | 17,2 | — | 21,4 | 37,5 | 4 | 4800 |
| 27 | RAB/$H_2O$ | 5 | 30,1 | 18,1 | 21,6 | 28 | 6,5 | 250 |
| 28 | RAO/$H_2O$ | 8 | 33 | 24 | 25,6 | 37 | 7 | 850 |

TABLE 7-continued

| test n° | | % gas | % (100°-500° C.) | level of conversion | % residual peak | % $C_5$ asphaltene | rating | $\eta_{cP}$ 100° C. |
|---|---|---|---|---|---|---|---|---|
| | Visbreaking with water of RAB and of RAO[1]BOSCAN at 420° C. $PH_2O$ (420° C.) = 20 b - level stage = 15 min | | | | | | | |
| 29 | RAB/DHA/$H_2O$[2] | 5 | 29,2 | 17,2 | 22 | 27 | 8 | 430 (å 60° C.) |
| 30 | RAO/DHA/$H_2O^2$ | 7 | 38,1 | 28,1 | 24,3 | 27 | 9 | 275 (å 60° C.) |

[1]RAO = RAB oxide with $H_2O_2/CH_3OH$
[2]% DHA = 15% (wt)

TABLE 8

| test n° | | 100° to 500° C. | 500° to 570° C. | 570° C.+ | residual peak |
|---|---|---|---|---|---|
| | Visbreaking with water 420° C. of RAB and of BOSCAN RAO. Percentages of the different fractions of the liquid phase. | | | | |
| | RAB | 17 | 22,3 | 40,5 | 20 |
| 27 | RAB/$H_2O$ | 30,1 | 22,2 | 26,1 | 21,6 |
| 28 | RAO/$H_2O$ | 33 | 18,7 | 22,7 | 25,6 |
| 29 | RAB/DHA/$H_2O$ | 29,2 | 23,3 | 25,5 | 22 |
| 30 | RAO/DHA/$H_2O$ | 38,1 | 20,4 | 17,3 | 24,3 |

TABLE 9

| test n° | | % C | % H | % N | % O | % S | $V_{ppm}$ | $Ni_{ppm}$ | H/C at. |
|---|---|---|---|---|---|---|---|---|---|
| | Vis breaking with water of RAB and of BOSCAN RAO at 420° C. Centesimal analysis | | | | | | | | |
| | RAB | 82,25 | 10,43 | 0,75 | 0,97 | 5,24 | 1300 | 120 | 1,54 |
| | RAO | 81,5 | 10,1 | 0,6 | 2,2-2,5 | 5,2 | 1200 | 115 | 1,48 |
| 27 | RAB/$H_2O$ | 82,6 | 9,75 | 0,81 | 0,98 | 5,35 | 985 | 92 | 1,42 |
| 28 | RAO/$H_2O$ | 82,9 | 9,54 | 0,93 | 1,33 | 5,17 | 475 | 52 | 1,38 |
| 29 | RAB/DHA/$H_2O$ | 83,35 | 9,90 | 1,06 | 0,70 | 5,37 | 1195 | 125 | 1,42 |
| 30 | RAO/DHA/$H_2O$ | 82,70 | 9,80 | 0,96 | 1,22 | 5,4 | 650 | 80 | 1,42 |

We claim:

1. A process for the visbreaking, hydrovisbreaking or catalytic hydrogenation of a charge consisting of a petroleum fraction, a heavy crude oil, a refining residue a fraction derived from coal or a fraction derived from bituminous sand or schist, said process comprising subjecting said fraction to a thermal treatment in the presence of 1 to 50% by weight of at least one radical generating monooxygenated organic compound, containing at least one heteroelement selected from sulfur and nitrogen and in which the oxygen is bonded to said heteroelement.

2. A process according to claim 1, wherein said compound is a sulfur oxide and/or a nitrogen N-oxide.

3. A process according to claim 1, wherein the sulfur oxide is a dialkylsulfoxide, a diarylsulfoxide, an alkyularylsulfoxide and a thiophenic sulfur oxide, and wherein the nitrogen N-oxide is a trialkylamine oxide, a triarylamine oxide, an amine oxide having at least one alkyl group and at least one arlyl group and an aromatic nitrogen oxide.

4. A process according to claim 1, wherein said oxygenating compound is dimethylsulfoxide, diphenylsulfoxide, didodecylsulfoxide, thiophene oxide or benzothiophene oxide, or a hydrocarbon fraction containing sulfur and/or nitrogen, oxygenated ex situ.

5. A process according to claim 1, wherein said oxygenated compound, reduced after heat treatment, is separated, regenerated by oxidation ex situ and recycled into the charge.

6. A process according to claim 1, wherein before the thermal treatment said heavy fraction is subjected to gentle oxidation by at least one peroxide.

7. A process according to claim 6, wherein said peroxide is hydrogen peroxide.

8. A process according to claim 1, wherein at least one hydrogen donor diluent is used in addition.

9. A process according claim 8, wherein said hydrogen donor diluent is used in a proportion comprised between 10 and 400% by weight with respect to said charge.

10. A process according to claim 9, wherein said hydrogen donor diluent is tetrahydronaphtalene or dihydroanthracene, or a hydro-aromatic petroleum fraction, such as a partially hydrogenated LCO fraction.

11. A process according to claim 1, wherein in said thermal treatment consists of a visbreaking or a hydrovisbreaking process.

12. A process for catalytic hydrogenation, visbreaking or hydrovisbreaking of a charge consisting of a petroleum fraction, a heavy crude oil, a refining residue, a fraction derived from coal or a fraction derived from bituminous sand or schist, said process comprising subjecting said fraction to a thermal treatment in the presence of a minor proportion of at least one radical generating monooxygenated organic compound, containing at least one heteroelement selected from sulfur and nitrogen, said heteroelement being bonded to oxygen.

13. A process according to claim 12, wherein at least one monooxygenated compound is employed in the proportion of 1 to 50% by weight with respect to said fraction.

14. A process for the visbreaking, hydrovisbreaking or catalytic hydrogenation of a charge consisting of a petroleum fraction, a heavy crude oil, a refining residue, a fraction derived from coal or a fraction derived from bituminous sand or schist, said process comprising subjecting said fraction to a thermal treatment in the presence of a minor proportion of a least one radical generating monooxygenated organic compound, containing at least one heteroelement selected from sulfur and nitrogen, said heteroelement being bonded to oxygen, and in the presence of at least one hydrogen donor diluent.

15. A process according to claim 14, wherein the heavy fraction of organic materials is a petroleum fraction, a heavy crude oil, a refining residue, coal or a bituminous sand or schist.

16. A process according to claim 14, wherein the monooxygenated compound is employed in a proportion of 1 to 50% by weight with respect to said heavy fraction.

17. A process according to claim 14, wherein said thermal treatment is a visbreaking or a hydrovisbreaking process.

18. A process according to claim 14, wherein said hydrogen donor diluent is tetrahydronaphthalene, dihydroanthracene, or a hydro-aromatic petroleum fraction.

19. A process according to claim 1, wherein the heavy fraction of organic materials is a petroleum fraction, a heavy crude oil, a refining residue, coal or a bituminous sand or schist.

* * * * *